US007324131B2

(12) United States Patent
Liebig et al.

(10) Patent No.: US 7,324,131 B2
(45) Date of Patent: Jan. 29, 2008

(54) METHOD FOR SETTING A DEVICE FOR IMAGE REPRODUCTION ON PRINTING PLATES

(75) Inventors: Norbert Liebig, Felm (DE); Rainer Müllenhagen, Kiel (DE); Stefan Schmidt, Kiel (DE); Gerhard Vogler, Stubbendorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 277 days.

(21) Appl. No.: 11/123,488

(22) Filed: May 5, 2005

(65) Prior Publication Data

US 2005/0248779 A1 Nov. 10, 2005

(30) Foreign Application Priority Data

May 5, 2004 (DE) ..... 10 2004 022 712

(51) Int. Cl.
*B41J 2/47* (2006.01)

(52) U.S. Cl. ..... 347/240; 347/251

(58) Field of Classification Search ..... 347/16, 347/19, 37, 47, 232–235, 245, 248–254, 347/240; 382/190–191, 199–203; 358/504, 358/518

See application file for complete search history.

(56) References Cited

U.S. PATENT DOCUMENTS 4,878,063 A * 10/1989 Katerberg ..... 347/19
5,451,990 A * 9/1995 Sorenson et al. ..... 347/37
5,453,777 A 9/1995 Pensavecchia
5,831,658 A 11/1998 Iga et al.
6,394,579 B1 * 5/2002 Boyd et al. ..... 347/47
6,974,199 B2 * 12/2005 Endo ..... 347/16
7,014,289 B1 * 3/2006 Matsuda ..... 347/19
2002/0154207 A1 10/2002 Beier et al.
2004/0130613 A1 * 7/2004 To et al. ..... 347/245

FOREIGN PATENT DOCUMENTS

DE 101 08 624 A1 9/2002
JP 01 067 371 A 3/1989
JP 2000 153 660 A 6/2000
JP 2001 341 392 A 12/2001

* cited by examiner

*Primary Examiner*—Hai Pham
(74) *Attorney, Agent, or Firm*—Laurence A. Greenberg; Werner H. Stemer; Ralph E. Locher

(57) ABSTRACT

A method sets up a device for image reproduction on printing plates. The fastening of image reproduction members, their orientation and tolerances, and also tolerances in the positioning of the image reproduction members on a guide or a spindle, lead to mis-positions of the image reproduction members in relation to one another. Offsets of two adjacent image parts may occur. In the method, the printing plate has reproduced on it in the X-direction at least one first pattern which overlaps with the first pattern of an adjacent image reproduction member and/or the printing plate, in each case with a right and a left column, has reproduced on it in the Y-direction in each case at least three spaced-apart second patterns, such that in each case the right column of an image part is at least contiguous to the left column of an adjacent image part.

29 Claims, 6 Drawing Sheets

METHOD FOR SETTING A DEVICE FOR IMAGE REPRODUCTION ON PRINTING PLATES

BACKGROUND OF THE INVENTION

Field of the Invention

The invention relates to a method for the setting of a device for image reproduction on printing plates, in particular of an outer-drum printing plate exposer, with at least two image reproduction members, preferably exposure heads, which are provided so that image parts of a printing image can be reproduced seamlessly and without any offset with respect to one another, for which purpose desired positions are assigned to the image reproduction members, and actual positions of the image reproduction members are checked at least in relation to one another.

When an image is reproduced on a printing plate by two or more image reproduction members, the problem arises that the individual image parts of the resulting printing image must adjoin one another seamlessly without any offset. Otherwise, the joining points of the image parts can be seen and considerably diminish the qualitative impression of the printing image.

The image reproduction members may in this case be, in particular, exposure heads. These may be constructed from a plurality of laser diodes, which form a diode row or a matrix. Instead of being constructed from laser diodes, an exposure head may also be constructed, for example, from optical waveguides, which are connected in turn to laser sources.

The information of the printing image to be reproduced is initially in a data file. The image data file may in turn be or become divided into image regions, which are assigned to the individual image reproduction members. Each image region of the image data file then yields an image part of the printing image, the image part being reproduced by an image reproduction member. The individual image parts adjoin one another at joining points of the printing image.

During exposure, the drum of the outer-drum exposer is rotated together with the printing plate tension-mounted on the latter. As a result of the rotation of the drum, the image reproduction members reproduce an image on the printing plate in what is known as a fastscan direction or, based on an orthogonal coordinate system, in a Y-direction.

The image reproduction members can be moved on a guide orthogonally with respect to the Y-direction in what is known as the slowscan or X-direction, and they then reproduce individual image parts of the printing image from the corresponding image regions of the image data file according to the movements in the X and Y-directions.

To move the image reproduction members in the X-direction, the image reproduction members may be coupled to one another or may move independently of one another. Coupling may be achieved, for example, in that the image reproduction members are all moved in the X-direction by a spindle, which converts a rotational movement into a longitudinal movement of the image reproduction members, or in that they are all held at a fixed distance from one another on a common carrier. The coupling of the image reproduction members has the advantage that settings of the image reproduction members in relation to one another, once carried out, are maintained.

The fastening of the image reproduction members, their orientation in relation to the drum and tolerances in their specific internal construction, and also tolerances in the positioning of the image reproduction members on the guide or the spindle, lead to mis-positions of the image reproduction members in relation to one another.

The result of these mis-positions is that various image reproduction members, as intended in their desired positions, no longer reproduce dots lying on a common straight line. The image parts reproduced by two adjacent image reproduction members have an offset in the Y-direction.

Deviations of the actual positions of the image reproduction members from their desired positions also have the result, in particular, that various image parts may overlap one another in the X-direction or a gap between them may arise, and therefore a seamless joining is not ensured. An easily visible offset of two adjacent image parts in the X-direction then occurs.

U.S. Pat. No. 5,453,777 presents a method for reducing the X and Y-offset of a plurality of exposure elements. The exposure elements presented are laser members. The laser members are all seated in a writing head. On account of eccentricities of the laser members, corresponding offsets occur among the individual laser members in each case in relation to one another. It is proposed that the Y-offsets are compensated by a time offset of the activation signals of the laser members. The offsets in the X-directions are to be corrected, according to U.S. Pat. No. 5,453,777, in that a laser which, for example, would also expose the region of a previous laser commences the exposure of its image part later only after corresponding revolutions of the drum. It would then completely expose the image part assigned to it. How the offsets are to be detected is not mentioned.

SUMMARY OF THE INVENTION

It is accordingly an object of the invention to provide a method for setting a device for image reproduction on printing plates which overcomes the above-mentioned disadvantages of the prior art methods of this general type, by which the quality of a resulting printing image can be increased, in that as offset-free a printing image as possible is produced, and, in particular, a method for checking the actual positions of the image reproduction members is to be specified.

The object is achieved, according to the invention, by a method for the setting of a device for image reproduction on printing plates, in particular of an outer-drum printing plate exposer, with at least two image reproduction members, preferably exposure heads, which are provided so that image parts of a printing image can be reproduced seamlessly and without any offset with respect to one another. For which purpose desired positions are assigned to the image reproduction members, and actual positions of the image reproduction members are checked at least in relation to one another. The method is distinguished in that the actual positions of the image reproduction members are checked in an X-direction and/or a Y-direction substantially orthogonal to the latter. To check the actual positions, a printing plate has reproduced on it in the X-direction of each image reproduction member at least one first pattern which overlaps with at least one first pattern of at least one adjacent image reproduction member.

Where a test pattern of this kind is concerned, advantageously a defined overlap, that is to say a defined offset of the image parts, is always provided first. X-offsets can then advantageously be identified by possible deviations of the actual overlap from the defined overlap, with the result that conclusions can be drawn as to deviations of the actual positions of the image reproduction members from their desired positions.

In another method step, which may preferably also be additionally provided, there is further provision that, to check the actual positions, the printing plate, in each case with a right and a left column, has reproduced on it in the Y-direction of each image reproduction member in each case at least three, preferably a plurality of, second patterns spaced apart from one another in the longitudinal direction, in such a way that in each case the right column of an image part of an image reproduction member is at least contiguous to the left column of an adjacent image part.

In this case, in particular, there may also be provision for the respective adjacent columns also to overlap one another.

On the basis of deviations of the second patterns from adjacent columns in the Y-direction, a conclusion can then advantageously be drawn as to deviations of the actual positions of the image reproduction members from desired positions in the Y-direction. Use of at least three second patterns per column in this case increases the quality of detection. The clarity with which a misposition in the Y-direction can be detected may also be increased, according to the invention, in that the orientation of the second patterns of a column is selected just such that, precisely in the case of a misposition, a second pattern of the first column is easily detectable in an alignment in the X-direction with a second pattern of the second column of an adjacent image reproduction member, and, in particular, this may be executed in such a way that, in practice, a second pattern of one image reproduction member merges seamlessly into a second pattern of a contiguous image reproduction member. The second patterns may be formed of, for example, of a first sub-pattern and of a second sub-pattern complementary to the latter.

According to the invention, there is advantageously also provision for the mispositions detected in the ways described above to be prevented or compensated. The quality of the printing image can thereby be improved, since at least fewer offsets occur in the X and Y-directions.

An advantageous further development of the method according to the invention provides that the at least one first pattern is constructed from at least one left and one right sub-pattern which are assigned in each case to a left and a right region of the image part reproduced by the image reproduction member. Superpositions of the left with the right sub-patterns can thereby be detected quickly and reliably.

So that it can be judged how large the overlap of the individual image parts is, there is provision for the at least one left and/or right sub-pattern to contain a flight of stairs with stair steps. The overlapping stair steps then give an indication as to the amount of overlap.

So that a more accurate conclusion can be drawn as to the amount of overlap on the basis of the overlapping stair steps, there is advantageously further provision for the transverse extent of the stair steps which runs from left to right to correspond to the extent of a pixel produced by an exposer head. If one stair step more overlaps, the conclusion can be drawn as to the overlap of the exposure members in the X-direction by the amount of one further pixel. The width of a pixel is in this case known for an exposure process, but may vary from image reproduction device to image reproduction device. It corresponds to the smallest structural width capable of being illustrated by the image reproduction members.

There is further provision for the at least one first pattern to contain distinguishable characters, preferably numerals, assigned to the stair steps. Each stair step is thereby in a simple way assigned a specific value in terms of the deviation of the actual position of an image reproduction member from its desired position. The deviation value assigned to an overlapping stair step can thereby be detected in a simple way.

In a further development, there is provision for the at least one right and/or left sub-pattern to contain at least one bar running longitudinally, that is to say extending in the Y-direction. Advantageously, the stair steps of one image reproduction member can then be covered exactly by the bar of the adjacent image reproduction member. Which stair steps are covered can then give information on the size of the misposition of the associated image reproduction members.

In a particularly advantageous embodiment, there is provision for an image reproduction member in each case to reproduce an image on a region of a printing plate that is wider than the distance between two adjacent image reproduction members.

The stair steps or those regions of the first patterns, which overlap one another can then be assigned a zero point. In particular, a stair step may be characterized by the numeral zero, when this stair step is just or just not concealed by a bar when no X-offset occurs. On this basis, the adjacent stair steps may be assigned in the transverse direction negative and positive values which exactly indicate the number of pixels by which, in the event of concealment or just no concealment, the actual position of one of the image reproduction members involved deviates in the X-direction from its desired position.

There may be a provision, furthermore, for using an image data file for image reproduction which has image regions, which are assigned to the image reproduction members and the transverse extents of which are in each case greater than the distances between two image reproduction members. An intended or defined overlap of adjacent image parts can be achieved in this simple way. As provided in the image data file, the individual image reproduction members will expose the printing plate further into the image part, which has already been exposed by a following image reproduction member. A gap between the reproduced image parts can thereby advantageously be avoided even in the case of corresponding mispositions of the image reproduction members.

So that an offset of the image reproduction members in the X-direction can be taken into account during a subsequent exposure of a printing plate, there is provision, according to the invention, for detecting in each image part assigned to an image reproduction member a first stair step not concealed by a bar. This may take place preferably, using optical aids, in particular automatically. If there is provision for the stair steps to be identified according to the invention, the identification can be read off, so that it is known immediately how many pixels the offset amounts to in the X-direction. In this case, both negative and positive amounts are possible. The offset, here, is always the relative offset of the image reproduction members involved in the superposition of stair steps and bars.

In an alternative embodiment, there is likewise provision for detecting in each image part assigned to an image reproduction member a last stair step superposed by a bar. The advantages listed above apply similarly here.

In the determination of an X-offset of an image reproduction member, the X-offset of a specific, preferably of the first image reproduction member from a desired position may be assumed to be zero. This deviation is set arbitrarily. The further desired positions of the remaining image reproduction members are then in each case relative desired positions with respect to this first image reproduction member. The offsets for an image reproduction member, which are detected by the method described are always relative offsets of an image reproduction member with respect to the adjacent image reproduction member. Depending on the position of the judged image reproduction member, the deviations of a plurality of further successive image reproduction members must then be reckoned up in order to assign to each detected deviation an offset of the actual position of an image reproduction member with respect to its desired position in each case in relation to the first image reproduction member. The offsets can thereby be standardized to a selected, preferably a first image reproduction member. This applies to offsets both in the X-direction and in the Y-direction.

According to the invention, there is advantageously provision, depending on the position of the detected stair step or on the character assigned to it, for widening or shortening the boundaries or the extents of the image parts assigned to the image reproduction members, according to the detected offset of the image reproduction members in the X-direction. In this way, possible deviations of the actual positions of the image reproduction members from their desired positions can be compensated, and, in particular, the occurrence of a gap between or the overlap of two image parts can be avoided in a simple way.

According to the invention, there is advantageous provision, depending on the position of the detected stair step or on the character assigned to it, for widening or shortening the boundaries or the extent of image regions which are assigned to the image reproduction members and are covered by an image data file provided for image reproduction, according to the detected offset of the image reproduction members in the X-direction, and for reproducing image parts according to corresponding data of the image data file. In this way, the extents of the image parts can be widened or shortened, as described.

In an inventive further development, there is advantageously provision for the longitudinal distances in the Y-direction between the at least three second patterns, spaced apart from one another, of the left/right column to be different from the longitudinal distances of the right/left column, in each case by the amount of one pixel width. In the case of a continuation of a second pattern of a left/right column into a second pattern of an adjacent right/left column, a conclusion can then be drawn as to an offset in the Y-direction or exactly no offset, depending on which second patterns just adjoin one another in such a way that one second pattern continues into the other. Since the distances increase in each case by the width of a pixel, the amount of the offset in the Y-direction can be determined in pixels by the position of the coinciding patterns. The determination advantageously takes place on the basis of pixels. If, for example, there is no offset of adjacent image reproduction members in the Y-direction, then in each case specific pairs of adjacent second patterns are to have a defined offset in the Y-direction with respect to one another.

The distances between the second patterns do not in this case necessarily have to differ from one another by the width of a pixel. Other distances are also possible, and, in particular, it is possible for the distances within a column to be different. The choice of a distance difference of one pixel has the advantage that offsets in the Y-direction by the amount of a few pixels can be detected quickly and simply.

According to the invention, there is further provision for a second pattern to have at least three, preferably a plurality of transversely oriented parallel elements spaced apart from one another variably in the longitudinal direction. Advantageously, a continuation of two second patterns one into the other in pairs, as described above, can thereby be judged more easily. The individual elements of a second pattern of a right column and of a left column of an adjoining image part are in this case to be disposed identically. A continuation of two second patterns can thereby be detected more easily, since, for this purpose, all the elements of a second pattern must also be continued in pairs into corresponding elements of an adjacent second pattern. The elements may be, for example, triangles or else, preferably, parallel lines orthogonal to the Y-direction.

In a development according to the invention, there is advantageously provision for the longitudinal distances between the at least three elements of a second pattern which are spaced apart from one another to increase or decrease in each case aperiodically, in particular by the amount of one pixel width. A continuation of more than one element of two second patterns in pairs is possible only when the corresponding second patterns are continuous to one another without any offset. A random continuation of more than one element in pairs is advantageously not possible.

In a particularly advantageous embodiment, the second patterns of image reproduction members adjacent to one another overlap one another. In this case, if there is a sufficient overlap in the second patterns of image reproduction members adjacent to one another, no microscopic inspection is necessary for an initial judgment, even in the case of a very small offset of the patterns relative to one another of the order of 0.01 mm.

As a result of the overlap, the number of addressed, that is to say exposed pixels, in the case of an exposer the exposed surface, is lower in the region of the overlap when the two second patterns lie one above the other. When the addressed or exposed surfaces have a contrast with respect to the unaddressed surfaces, then the overlap region in the case of the pair investigated during the evaluation appears in a brightness other than that in the case of the pairs in which the pattern is not continued without an offset from one image part into the other image part. This change may advantageously also then be detected without a microscope even when the offset itself is of a microscopic order of magnitude.

There is further provision for the second patterns of a column to be capable of being identified graphically, preferably using numerals, as a function of the defined offset of a second pattern of a left/right column of one image region with respect to a second pattern of a right/left column of the adjacent image region. The defined offset in the Y-direction is obtained from the image data, which in each case provide different distances between the second patterns of a left or right column. As a result, only one second pattern of a left column has, according to the image data, an offset-free joining in the Y-direction with respect to a second pattern of an adjacent right column. For example, starting from this, the defined offsets for second patterns adjacent to one another may always increase within the columns.

Arrangements may also be envisaged in which the defined offsets within adjacent columns of second patterns completing one another do not decrease or increase linearly in one direction. Depending on the respective distances between the second patterns of a column, any pairs of second patterns of two columns adjacent to one another may have different defined offsets. The only important factor should be that so many different defined offsets are provided that they correspond to all possible offsets capable of occurring in practice due to mis-positions of the image reproduction members. If an offset then occurs in this way, just the defined offsets, which correspond to this are consequently compensated.

Advantageously, by virtue of the graphical identification of the second patterns adjacent to one another without an offset in the Y-direction, the conclusion can be drawn immediately as to the offset in the Y-direction of the image reproduction members. If numerals are used as identification, then the pixel-accurate offset can be read off in the case of the corresponding numbering, in which the two second patterns which, according to the image data, are intended to be adjacent to one another without an offset in the Y-direction are to be identified by zero. The defined offset in the Y-direction of a pair of second patterns is then compensated exactly by an offset which actually occurs, the identification of the pair of second patterns by the amount of the defined offset then simplifying the detection of the offset actually occurring due to mis-positions of the image reproduction members.

So that an offset in the Y-direction can be compensated, in particular automatically, there is advantageously provision for a second pattern of a left or right column to be detected in each case in each image part assigned to an image reproduction member, the second pattern adjoining, essentially without an offset, a second pattern or a right or left column of an adjacent image region.

The data thus detected may then be used, according to the invention, in such a way that, in further printing methods, the reproduction of an image on the printing plate commences, for image reproduction members reproducing image parts adjoining one another, at later or earlier times as a function of the detected second patterns adjoining one another without an offset, in particular with the detection of their graphical identifications, in particular numerals. Exact changes in the commencement times for the image reproduction members depends in this case on the rotational speed of the drum and on the detected offsets of the image reproduction members in the Y-direction.

In general, the calculated offsets in the X and Y-directions, the left image part of the first image reproduction member is postulated as being without offset. This may, however, in principle, be selected arbitrarily, since only relative offsets are to be corrected. The corresponding offsets of the adjacent image parts are added up, and the image reproduction members are always set in relation to this first image reproduction member.

An example of a possible method for the setting of a device for image reproduction on printing plates, from which further inventive features may also be gathered, is described below.

According to this example, an image is reproduced on a printing plate in an outer-drum exposer. In this case, reproduction on the printing plate is carried out simultaneously by at least two image reproduction members. The image reproduction members are disposed in a row one behind the other in the direction of the drum axis, in the X-direction. Each image reproduction member sweeps over a narrow band along the Y-direction on the drum when the latter rotates, and an image part can be reproduced on the drum surface as a result of the displacement of the image reproduction members in the direction of the drum axis. In the case of a sufficiently large displacement, a first image reproduction member sweeps over the image part already reproduced by the leading adjacent second image reproduction member, with the result that a defined overlap region can be brought about.

According to the invention, at the start of image reproduction, a second image reproduction member reproduces at the boundary with the part image reproduced by the first image reproduction member, as a sub-pattern of a first pattern according to the invention, a mark, for example in the form of a line or of a broad stroke which extends along the part image boundary in the Y-direction. At the end of the image reproduction, a pattern adding to the mark is reproduced by the first image reproduction member as a second sub-pattern of a first pattern according to the invention, in such a way that this overlaps with the mark. According to the present invention, the pattern adding to the mark is configured such that the displacement of the positions of the part images in the X-direction with respect to one another can be determined quantitatively. This may be achieved, for example, in that the pattern adding to the mark is in the form of a flight of stairs, the width of the steps in the X-direction corresponding to the required resolution of the displacement in the X-direction or to the smallest structural width capable of being illustrated by the image reproduction members, if this is required. The height of the steps may advantageously be selected such that each step can be assigned a designation, which allows a simple identification of the step during evaluation.

For judgment, that step is then selected which best coincides with the marking or, in another preferred embodiment, which is covered completely by the broad stroke serving as marking.

The selected step then gives information on the amount and orientation of the displacement toward the desired position in relation to the adjacent image part in the X-direction.

The correction of the displacement of the image part may then take place in various ways. One possibility would be the mechanical correction of the positions of the image reproduction members in the X-direction according to the determined inputs. Since this mostly entails a considerable outlay, generally a purely logical adaptation for the regions actually addressed by the various image reproduction members is carried out and, consequently, the extent or boundaries of the image parts are adapted.

For this purpose, for example, if a displacement with positive orientation would result in a gap between the image parts, additional image dots are added to the image part, which is reproduced by the first image reproduction member. Conversely, image dots are subtracted from the image part, which is reproduced by the first image reproduction member when the displacement has taken place in the opposite negative direction and an overlap of the image parts would occur.

The overlap of the image parts, which is required for the method according to the invention may, of course, also be achieved in a way other than that described above. One possibility would be to produce the overlap at the commencement of image reproduction, in which the start of the image part of the second image reproduction member is displaced in the direction of the image part of the first image reproduction device.

The method may likewise also be employed when other image reproduction methods are used, such as, for example, flat-bed or inner-drum exposers, in which two or more image reproduction members are to reproduce image parts which adjoin one another seamlessly and at the boundaries of which gaps or overlaps may occur.

In this case, the method described may also be employed additionally in a direction orthogonal to the X-direction when an image part which is to be reproduced by another adjacent image reproduction member and is to be joined on seamlessly is likewise located in this direction.

In the case of the outer-drum exposer, on which this example is based, no further image parts adjoin an image part in the Y-direction, but the image parts adjacent in the X-direction must be positioned in the Y-direction in such a way that no offset occurs between the image parts.

In order to determine the offset between adjacent image parts, according to the invention a second group of test patterns is reproduced as second patterns according to the invention at the boundary between two image parts.

In this case, a completing test pattern, which is reproduced by the second image reproduction member, stands opposite each test pattern, which is reproduced at the boundary by the first image reproduction member. A test pattern is thus constructed in each case from a group of elements according to the invention of the second patterns. The simple term "pattern" is also understood below to mean, in particular, a pattern, which is constructed from the abovementioned elements of the second patterns according to the invention.

One of these pairs distinguishes the desired state, inasmuch as the test pattern can be continued from one image part into the other without any offset when both image parts are positioned optimally in the Y-direction. The remaining at least two pairs of test patterns adjoin one another, preferably in both directions, along the boundary of the image parts in the Y-direction and between the completing test patterns have a defined offset which becomes greater in steps.

If the two image parts are thus offset relative to one another in the Y-direction, then it is not the pattern of the pair distinguishing the desired state and having the smallest possible offset which is continued from one image part into the other image part, but, instead, the pair of test patterns, the defined offset of which best compensates the displacement of the image parts in the Y-direction.

Advantageously, each pair may be assigned a designation, which allows a simple identification of the pair during evaluation. That pair is selected for evaluation the pattern of which is continued from one image part into the other image part with the smallest possible offset. The displacement can then be determined from the defined offset of this pair.

Lines which run orthogonally to the Y-direction in the X-direction are proposed as suitable patterns for the method according to the invention. A plurality of parallel lines with the smallest structural width still resolved by the image reproduction members is particularly advantageous for judging small displacements of the image parts with respect to one another. The distance between the lines is varied aperiodically, thus making it easier to establish a displacement, in contrast to identical distances between the lines. A plurality of lines of equal distance presents problems in establishing a displacement of exactly this distance. An aperiodically varying distance between the lines is achieved here simply by continuously widening the distance between the lines within the pattern of a pair. In an exemplary embodiment, a line with a width of one pixel is first repeated at a distance of one pixel, then at a distance of two pixels, and so on and so forth, the distance from the preceding line being increased in each case by one pixel, until a pattern dimension favorable for observation is obtained.

An overlap of the mutually completing patterns or test patterns of a pair is advantageous for judging the above-described exemplary embodiments of suitable patterns, but also in very general terms.

A first reason for this is that, in the case of an unfavorable displacement of the image parts in the X-direction, a gap between the completing parts of a pair may occur which makes it difficult to judge the offset with which the pattern of a pair is continued from one image part into the other image part.

A further advantage arises with regard to the last-described advantageous exemplary embodiment of a pattern favorable for judging the offset and consisting of lines of a width of one pixel, the distance between which increases continuously. In this case, if there is a sufficient overlap of the completing parts, no microscopic inspection is necessary for an initial judgment, even in the case of a very small offset of the test patterns with respect to one another, which is of the order of 0.01 mm.

Owing to the overlap, the number of addressed pixels, in the case of an exposer the exposed surface, is lower in the region of the overlap when the two completing patterns of a pair lie one above the other. If the addressed or exposed surfaces have a contrast with respect to the unaddressed surfaces, then the overlap region appears in a different brightness in the pair investigated during evaluation other than that in the pairs in which the pattern is not continued without an offset from one image part into the other image part. This change may advantageously also then be detected without a microscope even when the offset itself is of a microscopic order of magnitude.

The correction of the established displacement in the Y-direction can then take place in various ways. One possibility would be the mechanical correction of the positions of the image reproduction members in the Y-direction according to the determined inputs. Since this mostly entails a considerable outlay, a purely logical displacement of the image part is generally preferred.

As regards the outer-drum exposure on which this example is placed, this may take place in the Y-direction, that is to say the direction of rotation of the drum, in that the tracks recorded during each revolution for the adjacent image reproduction members commence at different times. Thus, the various image parts can be positioned with respect to one another in the Y-direction independently of the mechanical position of the image reproduction members.

In principle, the purely logical adaptation of the positions of the image parts is possible whenever the region, which can be swept by the image reproduction members is larger than the image part to be reproduced.

The method described may also be employed in a direction orthogonal to the Y-direction when a plurality of image parts to be reproduced by various adjacent image reproduction members is to adjoin one another without any offset both in the Y-direction and in the X-direction.

The combination of both methods is advantageous, since, in general, an adaptation of the position of the image parts in the X and Y-directions is necessary. A combination of the methods results in the overlap of image parts adjacent to one another, the overlap being advantageous for determining the offset in the Y-direction by the method according to the invention, since it is brought about in order to carry out the determination of the position change in the X-direction by the method according to the invention.

Other features which are considered as characteristic for the invention are set forth in the appended claims.

Although the invention is illustrated and described herein as embodied in a method for setting of a device for image reproduction on printing plates, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
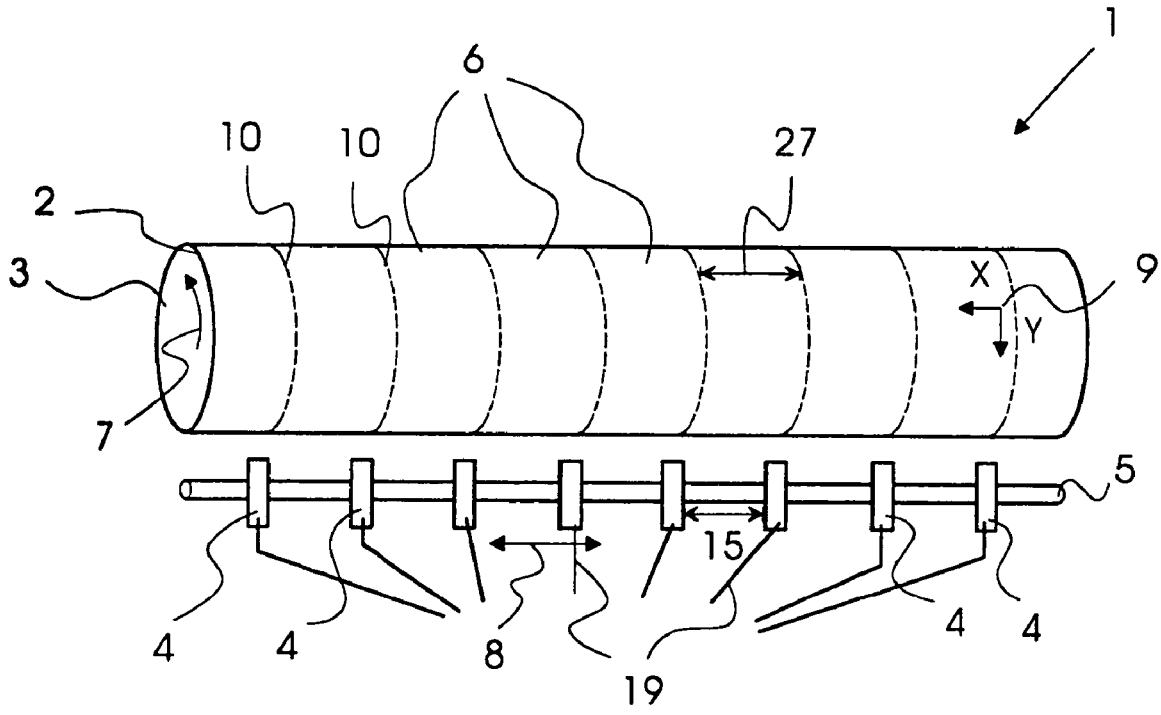
FIG. 1 is a diagrammatic, perspective view of a printing plate exposer with a plurality of image reproduction members and image parts according to the invention.

Referring now to the figures of the drawing in detail and first, particularly, to FIG. 1 thereof, there is shown a printing plate exposer 1. A printing plate 2 is tension-mounted on a drum 3 by non-illustrated fastening members.

For reproducing an image on the printing plate 2, eight image reproduction members 4 are illustrated here. It is also perfectly possible, however, that an image may be reproduced on the printing plate 2 by more than eight image reproduction members 4 or else only by two image reproduction members 4. The image reproduction members 4 here are to be exposure heads with laser diode cells. In principle, however, different image reproduction members 4 may also be used, which reproduce an image on the printing plate 2 digitally, in particular by pixels.

The image reproduction members 4 are fastened on a spindle 5 here. The image reproduction members 4 are supplied with data from an image data file via data lines 19. The image data are in this case subdivided into image regions, which are assigned in each case to an image reproduction member 4. An image reproduction member 4 is then addressed in such a way that it reproduces a corresponding image part 6 on the printing plate 2. For image reproduction, the drum 3 is rotated in the direction of arrow 7, while the image reproduction members 4 are moved on or by the spindle 5 in the direction of the double arrow 8 perpendicularly to the direction of rotation of the drum 3. A width 27 of an image part 6 in this case corresponds essentially to a distance 15 between two adjacent image reproduction members 4.

As a result of these two orthogonal movements, the rotation of the drum 3, on the one hand, and the lateral displacement of the image reproduction members 4, on the other hand, the image reproduction members 4 describe an orthogonal coordinate system 9 on the printing plate 2. The X-direction of the coordinate system 9 points in the direction of movement of the image reproduction members 4, while the Y-direction is determined by the rotation of the drum 3 and points opposite to the direction of rotation.

A complete printing image is thereby exposed on the printing plate 2 by the various image reproduction members 4. The individual image parts 6 of the image reproduction members 4 in this case butt together at joining points 10 on the printing plate 2. Owing to tolerances, inaccuracies in the installation of the image reproduction members 4 or the like, the image parts may initially have offsets at the joining points 10. Offsets both in the X-direction and in the Y-direction may occur.

Figure 2:
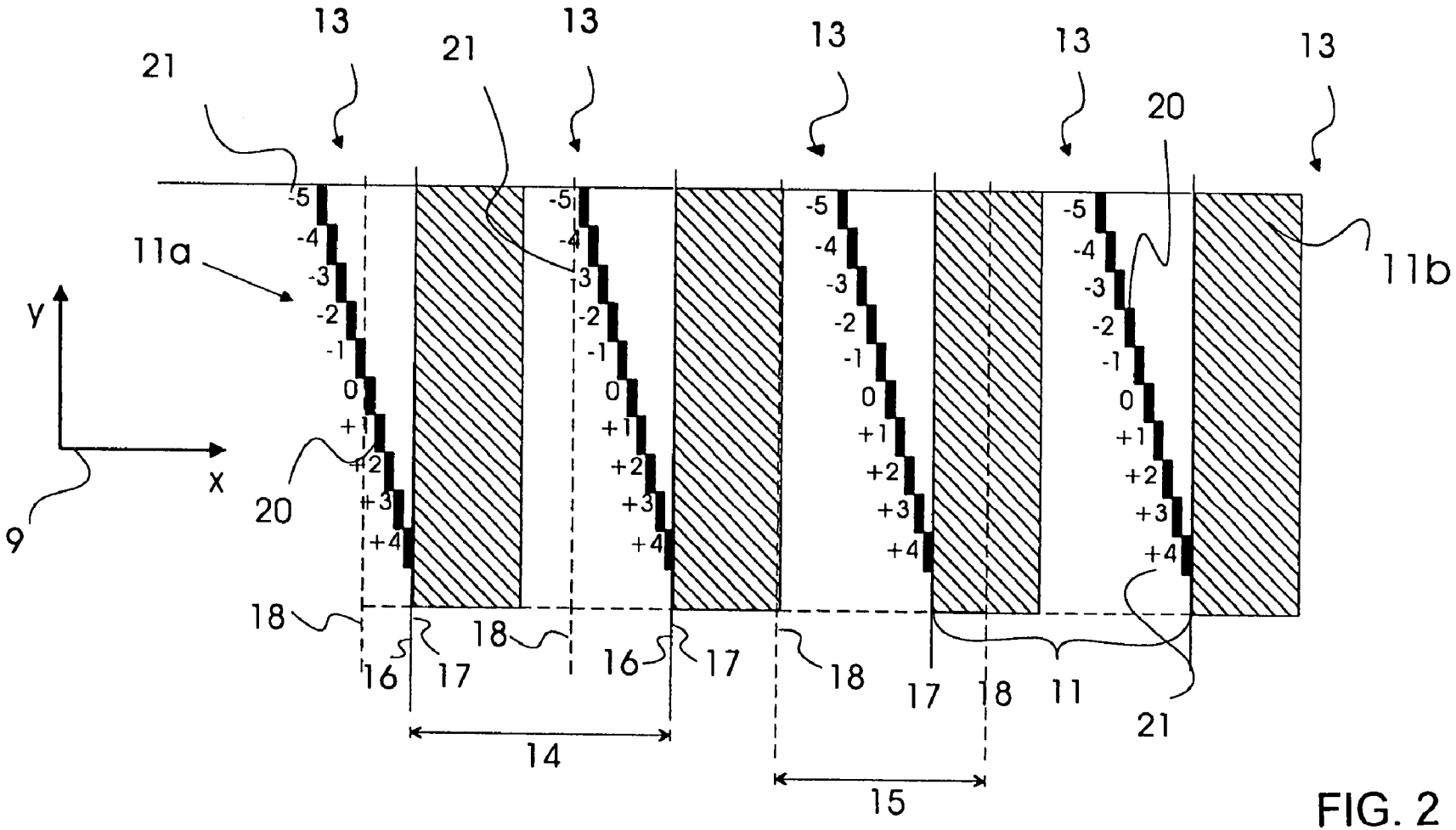
FIG. 2 is an illustration of sub-patterns of a first pattern of three mutually adjacent image reproduction members, such as are stored in an image data file.

FIG. 2 shows, according to an image data file, a plurality of sub-patterns 11*a*, 11*b* of a first pattern 11 of five image reproduction members 4 adjacent to one another. Identical elements are given the same reference numerals as in FIG. 1. X-offsets can be detected by the first patterns 11.

The first pattern 11 is in this case constructed from two sub-patterns 11*a* and 11*b*, which in each case cooperate with sub-patterns 11*b* and 11*a* of adjacent image reproduction members 4. The two sub-patterns 11*a* and 11*b* of two adjacent image reproduction members cooperate with one another inasmuch as their cooperation makes it possible to detect an offset of two image production members 4 adjacent to one another, as will be shown below. As they are illustrated here, the first patterns 11 are stored, for example, as a bitmap in a data file.

Only the right sub-pattern 11*a* of the first patterns 11 of a first left image reproduction member 4 is illustrated and only the left sub-pattern 11*b* of a last right image reproduction member 4 is illustrated.

In the instance illustration, the right sub-pattern 11*a* of a first pattern 11 is a flight of stairs with stair steps 20. The stair steps 20 have a longitudinal extent in the Y-direction, which exceeds the transverse extent in the X-direction. The width of the stair steps 20 in the X-direction is obtained from the smallest structural width capable of being exposed by the image reproduction members 4, in this case about 10 μm. Next to the stair steps 20, which are adjacent to one another in the X-direction without a gap, are located identification marks, in this case numerals 21.

The left sub-patterns 11*b* are broad strips or bars, the left edge of which lies exactly on an image region start 16 of an image region 13. The start 16 of an image region 13 is characterized by a continuous line. The image reproduction end 17 of an image region 13, on which the outermost right stair steps 20 of the sub-patterns 11*b* end, is likewise characterized by a continuous line. Each image region 13 is in this case assigned to an image reproduction member 4 and, in the instance illustrated here, contains in each case at least one first pattern 11. The transverse extent 14 of an image region 13 is defined by the distance between the image reproduction start 16 and the image reproduction end 17. The lines for identifying the start 16 and the end 17 are illustrated here merely for clarity and are not reproduced on a printing plate 2 or are an integral part of a data file. The ends 17 and starts 16 of adjacent image regions 13 directly adjoin one another here.

The transverse extent 14 in the instance illustrated here amounts to 192 mm. Other values, in particular different values for different image regions 13, are, however, also possible. In the instance illustration here, the distance 15 between two image reproduction members 4 amounts to 190 mm, and it is depicted symbolically here, for a better comparison with the transverse extent 14, as the distance between two lines 18.

During the exposure of the printing plate 2 according to the data of the image regions 13, as they are illustrated here, the image reproduction members 14 are displaced according to the transverse extent 14 while the drum 3 is rotating. Each image reproduction member 4 thereby exposes the image region 13 assigned to it onto the printing plate 2. Since the transverse extent 14 of the image region 13 is greater than the distance 15 between the image reproduction members 4 involved, the image reproduction end 17 of one image reproduction member 4 and the image reproduction start 16 of the following image reproduction member 4 no longer adjoin one another, and there is an overlap of the first marks 11, in particular the part marks 11*a* and 11*b* of two first marks 11, exposed on the printing plate 2 by the image reproduction members 4. This overlap is illustrated particularly in FIG. 3.

For simpler identification, distinguishable characters, here numerals 21, are assigned to the stair steps 20. The values of the numerals 21 are between −5 and +4 here. This is a simplified and limited illustration of actual conditions. On the basis of the overlaps of the stair steps 20 with the left sub-patterns 11*b* of an adjacent image reproduction member 4, a conclusion is to be drawn as to an offset in the X-direction of the two image reproduction members 4 with respect to one another. The width of the right sub-patterns 11*a*, that is to say the number of stair steps 20, is therefore to be selected such that even the greatest expected displacement of an image reproduction member out of its desired position can still be determined. In a realistic situation, it may be assumed, for example, that the deviation cannot amount to more than 2 mm in both directions. The width of a stair step 20 should correspond to the smallest possible structural width capable of being illustrated by the image reproduction members 4, here 10 μm. Consequently, to cover the entire width of 4 mm occurring due to the maximum deviations, overall 401 stair steps 20 are required, which are then identified correspondingly by numerals 21 from −200 to +200.

Figure 3:
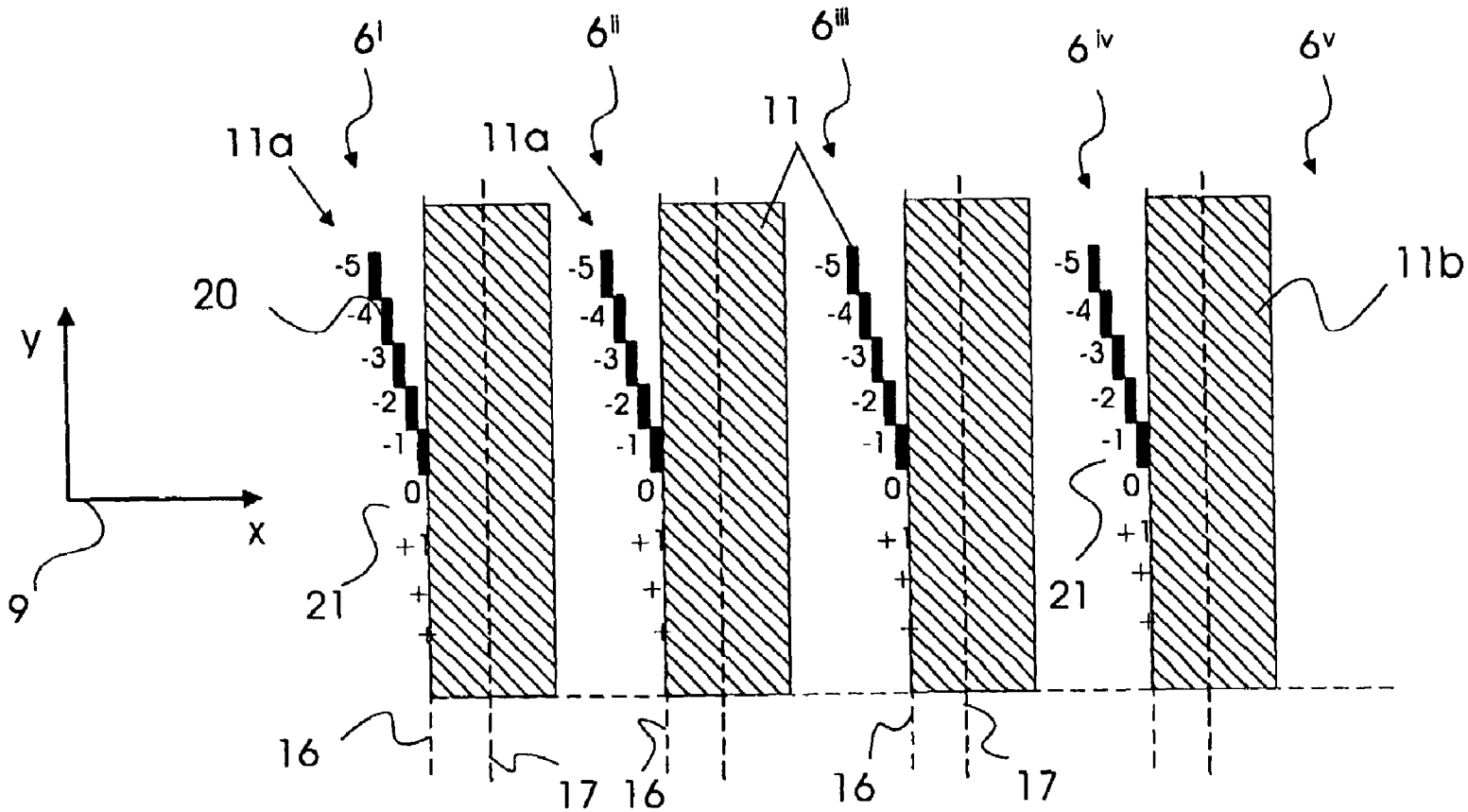
FIG. 3 is an illustration of mutually adjacent image parts for a printing plate with a reproduced image, with sub-patterns according to FIG. 2 without X-offset.

FIG. 3 illustrates a printing image, such as is produced by the first patterns 11 illustrated in FIG. 2, when the image reproduction members 4 have no offset in the X-direction.

As was stated with regard to FIG. 2, the transverse extents 14 of the image regions 13 deviate from the distances 15 between the image reproduction members 4 in each case by 2 mm. The image parts 6 therefore overlap one another between the lines of the image reproduction end 17 and the image reproduction start 16. Thus, a left image reproduction member 4 reproduces an image in each case into the image part 6, which is assigned to an adjacent image reproduction member 4. For greater clarity, the line, which identifies the image reproduction end 17 is darkened and the line assigned to the image reproduction start 16 is dashed. An overlap of adjacent image parts 6 can easily be understood from the line, lying on the right of the image reproduction start 16, of the image reproduction end 17 of the previous image reproduction member 4. Here, too, the number of stair steps 20 is purely symbolic, as is also the distance between the image reproduction start 16 and the image reproduction end 17 of adjacent image reproduction members 4. In a realistic instance, the stair steps 20 and the left part marks 11*b* would overlap one another by about 2 mm, always provided that there is no offset in the X-direction. The stair steps 20 are in this case disposed in such a way that just the stair step 20 which is identified by the numeral 21 "0" is concealed completely by the bar of the left sub-pattern 11*b* of the adjacent image part 6.

Should an offset occur in the X-direction, the bars of the left sub-patterns 11*b* will overlap the flight of stairs of the right sub-pattern 11*a* differently, depending on the amount of the offset, a different number of stair steps 20 then being concealed by the bars. The relative displacement of the adjacent image reproduction members 4 can be detected by the last stair step 20 concealed completely. In this case, in particular, the numeral 21 assigned to the last stair step 20 can be used as an indication of the relative offset. Here, the width of a stair step 20 is about 10 μm, and if the numeral 21 of the last concealed stair 20 is multiplied by 10 μm, the relative offset of the image reproduction members 4 is obtained directly in μm. The numeral 21 in itself indicates the offset in pixels.

Figure 4:
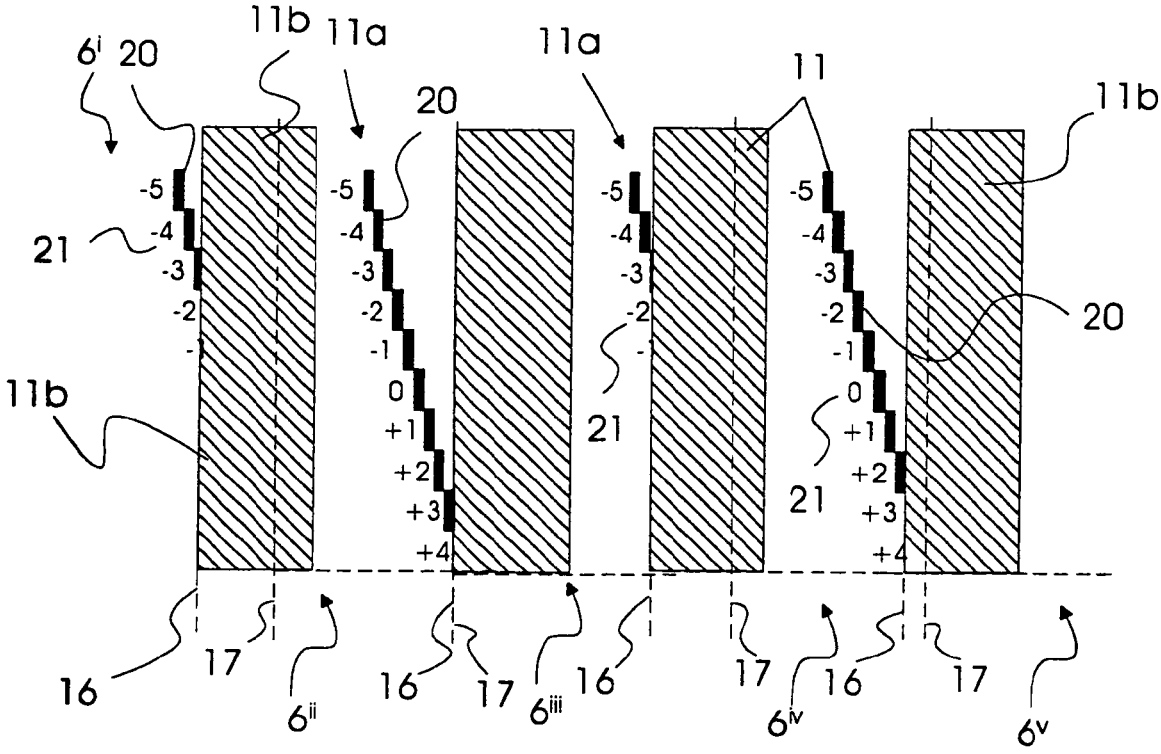
FIG. 4 is an illustration of mutually adjacent image parts for a printing plate with reproduced image, with sub-patterns according to FIG. 2 with X-offset.

A corresponding illustration of a printing image with patterns 11 in which an offset of the image reproduction members 4 in the X-direction occurs is shown in FIG. 4. Here, too, identical elements are designated by the same reference symbols again.

The distances between the image reproduction end 17 and the image reproduction start 16 of two adjacent image reproduction members 4 varies, depending on the X-offset.

Five image parts 6 are illustrated here, at least partially, which are assigned to five successive image reproduction members 4. In this case, it will be assumed that a first image part $\mathbf{6}^{i}$ has been reproduced by the outermost image reproduction member 4. Here, in particular, only the right sub-pattern 11*a* is illustrated. The following three image reproduction members 4 reproduced the image parts $\mathbf{6}^{ii}$, $\mathbf{6}^{iii}$ and $\mathbf{6}^{iv}$. The last image part $\mathbf{6}^{v}$ illustrated was reproduced by the fifth image reproduction member 4, only the left sub-pattern 11*b* of this being illustrated.

The first image reproduction member 4 is assumed to be offset-free. The bar of the left sub-pattern 11*b* of the second image reproduction member 4 conceals the flight of stairs of the right sub-pattern 11*a* of the first image reproduction member 4, so that the numeral 21 "−2" can still be seen, whereas the associated stair step 20 is concealed completely. It may be concluded from this that the second image reproduction member 4 has a relative offset in the X-direction with respect to the first image reproduction member 4 of −2 pixels.

The relative offsets of the further image reproduction members 4 can be determined in the same way. By an addition of the existing relative offsets, the respective offsets of any desired image reproduction member 4 with respect to the first image reproduction member 4 can then also be determined.

To correct the offsets in the X-direction thus detected, the laser diodes of an image reproduction member 4, which causes the offset initially to be switched off. There may be provision for an image reproduction member 4 then to reproduce an entire image part 6 without these diodes. It is also possible for these diodes to be switched off only for the period of time in which they would also reproduce the image part 6 of the previous image reproduction member 4.

The deviation of the distance 15 between two adjacent image reproduction members 4 from the desired distance can be read off by use of each pair of mutually cooperating sub-patterns 11*a*, 11*b* of the image reproduction members 4 adjacent to one another. Of the flight of stairs of the sub-pattern 11*b* in the image region $\mathbf{6}^{i}$ of the outermost left image reproduction member 4, the stair steps 20 with the numerals 21 "−5" to "−3" can be seen. The stair step 20 with the numeral 21 "−2" is concealed completely by the bar of the sub-pattern 11*b* of the adjacent image part $\mathbf{6}^{ii}$. In terms of the resolution of the method, therefore, it can be established that the image reproduction member 4 belonging to the image region $\mathbf{6}^{ii}$ is displaced to the left out of its desired position in relation to the outermost left image reproduction member by the amount of two pixel widths. Similarly, the displacement out of the desired position in relation to the adjacent image reproduction members 4 can be determined for all further image reproduction members. In the case of the present example, what is determined, in each case with respect to the left adjacent image reproduction member, is a displacement of +4 pixel widths for the image reproduction member belonging to $\mathbf{6}^{iii}$, of −2 pixel widths for that belonging to $\mathbf{6}^{iv}$ and of +3 pixel widths for that belonging to $\mathbf{6}^{v}$. The criterion applied here for the selected stair step 21 is that it must be concealed completely. The criterion is dependent on the exact image reproduction method. In the present instance, it allows for the fact that experience has shown that, in the exposure of printing plates 2, which is the basis of the invention, a gap between the image parts 6 can be detected more easily by an overlap. Wherever image reproduction methods are concerned, other criteria may be more expedient.

Should a positive offset in the X-direction occur, there may be provision for the image reproduction member 4 which reproduces an image part 6 on the left of the image part 6 having the positive offset to reproduce so far into the region of the adjacent image reproduction member 4 that gaps are avoided. In particular, for this purpose, there may be provision for corresponding image parts 6, for example $\mathbf{6}^{ii}$ and $\mathbf{6}^{iii}$, to be enlarged or reduced. These changes are made within a data file, which contains the data of an image reproduction to be carried out. These changes may be calculated, for example, by a CPU shortly before a printing order is transferred to a printing machine.

Figure 5:
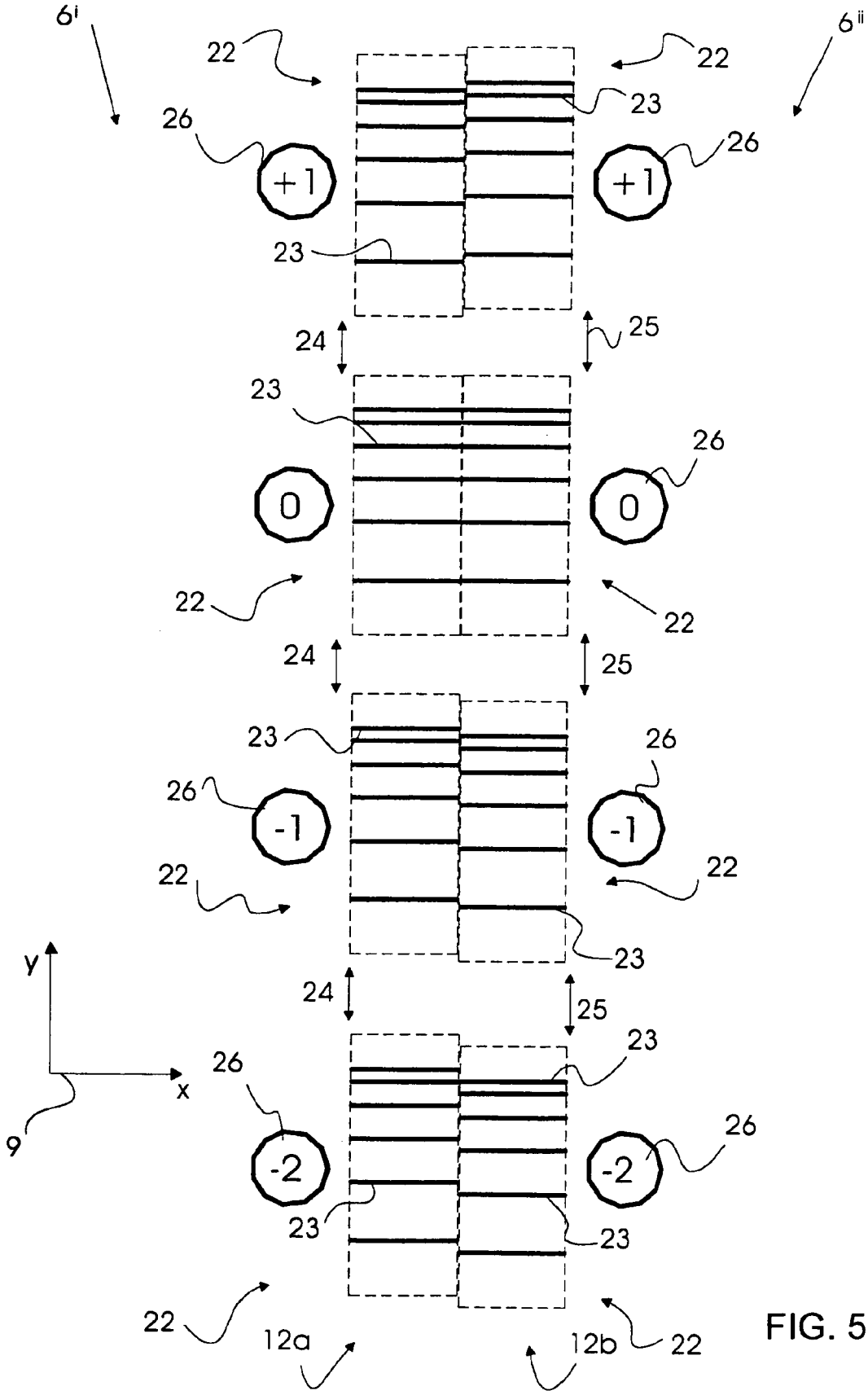
FIG. 5 is an illustration of a right and a left column of two mutually adjacent image parts with second patterns.

FIG. 5 shows a right column 12*a* and a left column 12*b*, in each case with four second patterns 22. The two columns 12*a* and 12*b* may also overlap one another, as may be the case, for example, when there is an offset in the X-direction of the two image reproduction members 4 reproducing the columns 12*a*, 12*b*. In particular, an overlap may even be provided in an offset-free instance. In the instance illustrated here, the illustration of an overlap was dispensed with for the sake of clarity. Furthermore, each column 12*a*, 12*b* may also have further second patterns 22 not shown here.

Each second pattern 22 has elements 23. Here, these elements 23 are parallel lines orthogonal to the Y-direction, which are spaced apart from one another aperiodically in the Y-direction in such a way that the distance between the elements 23 of a second pattern 22 is increased continuously. The increase in the distance corresponds here in each case to the width of a pixel. A line with the width of one pixel is first repeated at the distance of one pixel, the next line is then repeated at the distance of two pixels, and the distance between further lines is then further increased, in each case by one pixel.

The distances 24 between the second patterns 22 of the right column 12*a* in the Y-direction are equal. The same applies to the distances 25 between the second patterns 22 of the left column 12*b*. The distances 25 here are greater by one pixel than the distances 24. Other ratios of the distances 24 and 25 are also possible, as they are only to be unequal.

The width of the elements 23 in the Y-direction corresponds to the smallest width still capable of being resolved by the image reproduction members 4, that is to say the width of one pixel.

In the instance illustrated here, the image reproduction members 4 reproducing the image parts $\mathbf{6}^{i}$ and $\mathbf{6}^{ii}$ have no offset in the Y-direction, and the patterns 22 illustrated here can therefore also be present as a bitmap in a data file. The image data files of the two image parts $\mathbf{6}^{i}$ and $\mathbf{6}^{ii}$ are configured such that the elements 23 of the second patterns 22 of the right and left columns 12*a*, 12*b* which are identified by a numeral 26 "0" are adjacent to one another without an offset. The lines illustrated here are then continued without an offset from the first image part $\mathbf{6}^{i}$ to the second image part $\mathbf{6}^{ii}$. All the other lines of the patterns 22 of the two columns 12*a*, 12*b* have a corresponding offset of the transition from one image part $\mathbf{6}^{i}$ into the other image part $\mathbf{6}^{ii}$.

The second patterns 22 are assigned in each case graphical identifications in the form of numerals 26. These numerals 26 designate the expected offset of two second patterns 22 adjacent to one another when the corresponding image reproduction members 4 have exactly no offset in the Y-direction. The numerals 26 in this case assume corresponding positive and negative values, which correspond in each case to the number of pixels of the expected offset. The elements 23 of patterns 22 adjacent to one another have in each case, with the exception at the most of one line, an offset of the transition from the image part $\mathbf{6}^{i}$ into the image part $\mathbf{6}^{ii}$, if the patterns 22 with the numeral 26 "0" are disregarded.

If the image reproduction members 4 have an offset in the Y-direction in relation to one another, the columns 12*a* and 12*b* are displaced with respect to one another. The offsets of patterns 22 adjacent to one another are thereby varied, so that other second patterns 22 have elements 23 which adjoin elements 23 of an adjacent pattern 22 without an offset. Since the patterns 22 adjacent to one another are to have exactly an intended offset by the amount of a specific number of pixels, it is possible, depending on the numeral 26 of the patterns 22 then having no offset, to detect the number of pixels by which the columns 12*a* and 12*b* have been displaced with respect to one another. If, for example, the numeral 26 "−7" is assigned to the second patterns 22, then the right image reproduction member 4 is also displaced downward, that is to say opposite to the Y-direction of the coordinate system 9, by the amount of seven pixels in relation to the adjacent left image reproduction member 4. This direction assignment applies only when the drum 3 is rotating opposite to the Y-direction. If the drum 3 is rotating in the Y-direction, then opposite particulars apply. Should the Y-offset not have any integral numbers of pixels, then an offset of half a pixel and below this may in each case be interpreted as offset-free.

The offset in the Y-direction thus detected can then be corrected, for example, in that the right image reproduction member 4 commences image reproduction according to a basic image data file with exposure earlier by the amount of the period of time necessary for the reproduction of the seven pixels. This, too, applies only when the drum 3 is rotating opposite to the Y-direction.

The Y-offsets detected via the numerals 26 are in this case always relative offsets of the image reproduction members 4 involved. However, these offsets may be added up and related to a first image reproduction member 4.

Figure 6:
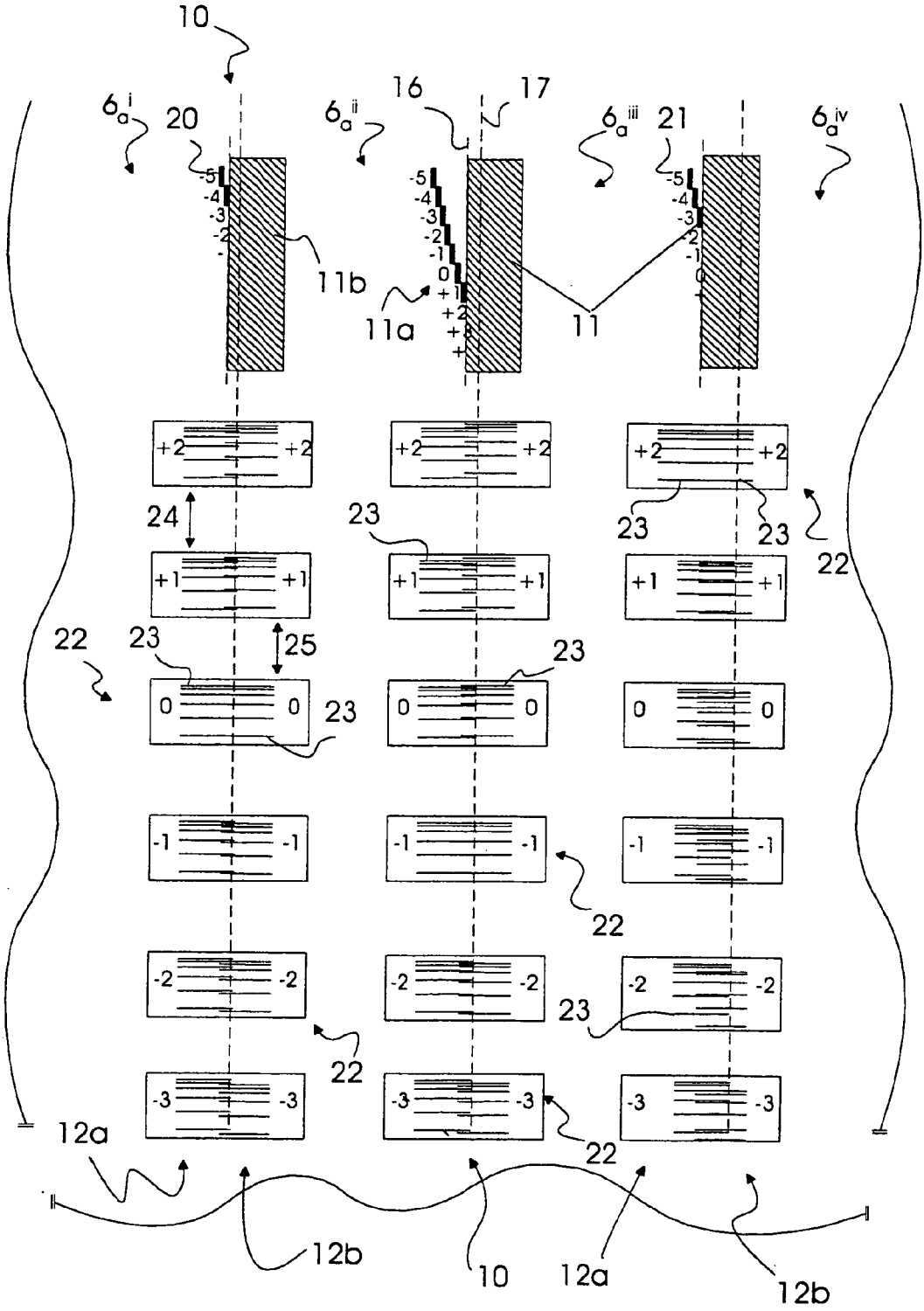
FIG. 6 is an illustration of image parts of a printing plate with reproduced image, with first and second patterns.

FIG. 6 illustrates a detail of a printing plate 2 on which first patterns 11 and second patterns 22 are reproduced. Image parts $\mathbf{6}a^{i}$, $\mathbf{6}a^{ii}$, $\mathbf{6}a^{iii}$ and $\mathbf{6}a^{iv}$ are shown, which may differ from or else be identical to the image parts 6 which were illustrated in the other drawings, although they are also designated here, in their entirety, as image parts 6 for simplicity.

X-offsets and Y-offsets and consequently the deviations of the actual positions from the desired positions of the image reproduction members 4 can be detected from the printed image shown and can be taken into account in the reproduction of the images on further printing plates 2.

The first patterns 11 for determining the X-offset are located in the upper region of the image parts 6. The image reproduction end 17 and the image reproduction start 16 are in each case identified by dashed lines, which are illustrated merely for the sake of clarity. The region between the image reproduction end 17 of an image reproduction member 4 and the image reproduction start 16 of an image reproduction member 4 adjacent on the right designates the joining point 10 of the two image reproduction members 4. In a situation without offsets, the image reproduction end 17 and the image reproduction start 16 will lie in the same position. However, for a test exposure, such as is described here, the image parts 6 of the image reproduction members 4 are to just overlap one another, so that there is always a distance between the image reproduction end 17 and the image reproduction start 16. In a real situation, such as is to be outlined here, the image parts 6 will overlap otherwise than intended because of inaccuracies, the distances between the image reproduction end 17 and the image reproduction start 16 varying correspondingly from joining point 10 to joining point 10, depending on the image reproduction members 4 involved.

The second patterns 22 for detecting the offsets in the Y-direction are illustrated in the lower region of the image parts 6. Owing to the intended overlaps of the image parts 6 and to the additional X-offsets, the second patterns 22 advantageously overlap one another in such a way that Y-offsets of the elements 23 of the transition from an image part 6 into an adjacent image part 6 are clearly detected solely on the basis of brightness differences. An analysis of the brightness values may take place, for example, optically via sensors or through a user.

The methods whereby offsets can be determined and more real first and second patterns 11 and 22 are constructed have already been explained in the previous figure descriptions. These then result in the following offsets for the image parts 6 illustrated here:

$\mathbf{6}^{ii}$ is displaced 3 pixels to the left with respect to $\mathbf{6}^{i}$ and has no offset in the Y-direction, $\mathbf{6}^{iii}$ is displaced 2 pixels to the right with respect to $\mathbf{6}^{ii}$ and is offset one pixel upward, and $\mathbf{6}^{iv}$ is displaced 2 pixels to the left with respect to $\mathbf{6}^{iii}$ and is offset two pixels downward.

These offsets can then be compensated for further printing orders which are to have image reproduction according to these test patterns. The X-offsets may in this case be compensated mechanically or via different activations of the optical elements of the image reproduction members 4, while the Y-offsets may be compensated, for example, via different time activations of the image reproduction members 4.

A mechanical correction of the positions of the image reproduction members in the X-direction according to the determined inputs usually entails a considerable outlay, and therefore a purely logical adaptation of the regions actually addressed by the various image reproduction members 4 is carried out and consequently the extent or boundaries of the image parts 6 are adapted.

For this purpose, for example if a displacement with positive orientation would result in a gap between the image parts, additional image dots are added to the image part 6 reproduced by the first image reproduction member 4. Conversely, image dots are subtracted from the image part 6 reproduced by the first image reproduction member 4 if the displacement has taken place in the opposite negative direction and an overlap of the image parts 6 would occur.

Corresponding methods described here can also be transferred when a plurality of image reproduction members 4 is connected one behind the other in the Y-direction and this matrix of image reproduction members is to have an offset-free setting.

This application claims the priority, under 35 U.S.C. § 119, of German patent application No. 10 2004 022 712.8, filed May 5, 2004; the entire disclosure of the prior application is herewith incorporated by reference.

We claim:

1. A method for setting a device for image reproduction on printing plates, the device having at least two image reproduction members provided for reproducing image parts of a printing image seamlessly and without any offset with respect to one another by assigning desired positions to the image reproduction members, which comprises the steps of:

checking actual positions of the image reproduction members at least in relation to one another by checking the actual positions of the image reproduction members in an X-direction and/or a Y-direction substantially orthogonal to the X-direction, and, the checking step being performed by the further steps of:

performing at least one of:

reproducing on a printing plate, in the X-direction of each of the image reproduction members, at least one first pattern overlapping in each case with the first pattern of at least one adjacent image reproduction member, the image reproduction members in each case reproducing an image on a region of the printing plate, which is wider than a distance between two adjacent image reproduction members; and reproducing on the printing plate, in each case with a right and a left column, in the Y-direction of each of the image reproduction members, in each case at least three second patterns spaced apart from one another in a longitudinal direction, such that in each case the right column of an image part of an image reproduction member is at least contiguous to the left column of an adjacent image part; and compensating for and/or preventing undesirable effects of mispositions thereby determined by use of at least one of the first and second patterns.

2. The method according to claim 1, which further comprises forming the first pattern with at least one left and one right sub-pattern, which are assigned in each case to a left and a right region of the image part of the image reproduction member.

3. The method according to claim 2, which further comprises forming one of the left and right sub-patterns as a flight of stairs with stair steps.

4. The method according to claim 3, which further comprises setting a transverse extent of the stair steps which run from left to right to correspond to a smallest structural width capable of being resolved by the image reproduction member.

5. The method according to claim 4, which further comprises forming the other of the right and left sub-patterns to contain at least one bar running longitudinally.

6. The method according to claim 4, which further comprises defining the smallest structural width capable of being resolved by the image reproduction member to be an extent of a pixel produced by the image reproduction member.

7. The method according to claim 3, which further comprises forming the first pattern with distinguishable characters assigned to the stair steps.

8. The method according to claim 7, which further comprises forming the distinguishable characters as numerals.

9. The method according to claim 3, which further comprises providing an image data file for the image reproduction, the image data file having image regions which are assigned to the image reproduction members and transverse extents of the image regions are in each case greater than distances between two of the image reproduction members.

10. The method according to claim 9, wherein depending on a position of a detected stair step or on the character assigned to it, widening or shortening boundaries or the extents of image regions which are assigned to the image reproduction members and are covered by the image data file provided for image reproduction according to a detected offset of the image reproduction members in the X-direction, and reproducing the image parts according to corresponding data of the image data file.

11. The method according to claim 3, wherein in the image part assigned to the image reproduction member, detecting a first stair step not concealed by a bar of the sub-pattern of an adjacent image reproduction member.

12. The method according to claim 11, wherein depending on a position of a detected stair step or on a character assigned to it, widening or shortening boundaries or extents of the image parts assigned to the image reproduction members according to a detected offset of the image reproduction members in the X-direction.

13. The method according to claim 11, wherein depending on a position of a detected stair step or on the character assigned to it, widening or shortening boundaries or the extents of image regions which are assigned, to the image reproduction members and are covered by the image data file provided for image reproduction according to detected offset of the image reproduction members in the X-direction, and reproducing the image parts according to corresponding data of the image data file.

14. The method according to claim 3, wherein in the image part assigned to the image reproduction member, detecting a last stair step concealed by a bar of the sub-pattern of an adjacent image reproduction member.

15. The method according to claim 14, wherein depending on a position of a detected stair step or on a character assigned to it, widening or shortening boundaries or extents of the image parts assigned to the image reproduction members according to a detected offset of the image reproduction members in the X-direction.

16. The method according to claim 14, wherein depending on a position of a detected stair step or on the character assigned to it, widening or shortening boundaries or the extents of image regions which are assigned to the image reproduction members and are covered by the image data file provided for image reproduction according to detected offset of the image reproduction members in the X-direction, and reproducing the image parts according to corresponding data of the image data file.

17. The method according to claim 1, which further comprises setting longitudinal distances between the at least three second patterns, spaced apart from one another, of the left/right column different from the longitudinal distances of the right/left column, in each case by an amount of one pixel width.

18. The method according to claim 17, which further comprises forming the second patterns, reproduced by adjacent image reproduction members, of two columns continuous to one another to overlap one another.

19. The method according to claim 17, which further comprises identifying the second patterns of a column graphically, using numerals, as a function of an expected resulting offset of a left/right column of one image part with respect to a right/left column of the adjacent image part.

20. The method according to claim 19, which further comprises detecting a second pattern of a left or a right column for each image part assigned to an image reproduction member, the second pattern adjoining, substantially without an offset, a second pattern of a right or left column of an adjacent image part.

21. The method according to claim 20, wherein for image reproduction members which reproduce image parts adjoining one another, a reproduction of an image on a printing plate commences, in further printing methods, at later or earlier times in dependence on detected second patterns adjoining one another without an offset.

22. The method according to claim 21, which further comprises detecting the graphical identifications of the detected second patterns.

23. The method according to claim 22, wherein the graphical identifications are numerals.

24. The method according to claim 1, which further comprises forming the second patterns to have at least three transversely oriented parallel elements spaced apart from one another variably in the longitudinal direction.

25. The method according to claim 24, which further comprises setting longitudinal distances between the at least three transversely oriented elements of the second patterns which are spaced apart from one another to increase or decrease in each case uniformly aperiodically, in an amount of one pixel width.

26. The method according to claim 25, which further comprises forming the second patterns, reproduced by adjacent image reproduction members, of two columns continuous to one another to overlap one another.

27. The method according to claim 1, wherein the device is an outer-drum printing plate exposer.

28. The method according to claim 1, wherein the image reproduction members are exposure heads.

29. The method according to claim 1, which further comprises providing an image data file for the image reproduction, the image data file having image regions which are assigned to the image reproduction members and transverse extents of the image regions are in each case greater than distances between two of the image reproduction members.

* * * * *